United States Patent [19]

Hoffman

[11] 4,037,843

[45] July 26, 1977

[54] BOARD GAME APPARATUS

[76] Inventor: Alfred J. Hoffman, 1411 N. Kenmore Road, Indianapolis, Ind. 46219

[21] Appl. No.: 611,483

[22] Filed: Sept. 25, 1975

[51] Int. Cl.[2] ..... A63F 3/02

[52] U.S. Cl. ..... 273/131 AB; 273/131 KP

[58] Field of Search ..... 273/131

[56] References Cited

U.S. PATENT DOCUMENTS 2,614,842 10/1952 Rice ..... 273/131 KP

FOREIGN PATENT DOCUMENTS 14,484 8/1881 Germany ..... 273/131 KP

*Primary Examiner*—Delbert B. Lowe

[57] ABSTRACT

Game apparatus consisting of a game board and four sets of playing pieces, enabling two, three or four persons to play an advanced game of checkers.

The board pattern is that as shown on the drawing, the numbers 1, 2, 3 and 4 representing four different colors or designations; playing piece numbers 1, 2, 3 and 4 matching those colors or designations as shown on the board, to assist in a uniform movement of playing pieces across the surface of the board for the purpose of a game.

1 Claim, 2 Drawing Figures

BOARD GAME APPARATUS

It is an object of this invention to provide a game board containing a center square matrix with intersecting horizontal and vertical lines forming 36 equally shaped matrices, said matrices being intersected by crossing diagonal lines forming four triangles in each matrix containing a set of color references in a clockwise direction as shown on the drawing by the numbers 2, 3, 2, 3 or 1, 4, 1, 4, thereby creating two sets of 18 alternating bicolored designated matrices to enable two different colored playing pieces to occupy the same matrix at different intervals of play. Extending from each side of the center matrix, equal thereto in length and one-third the area thereof, are collateral rectangles with intersecting lines forming 12 squares equal in size to the 36 center matrices, said 12 squares having adjacent sides using different designations or colors; two sets of said rectangles lying opposite each other and containing the same alternating color designated squares; one set represented by the numbers 2 and 1 and the other set represented by the numbers 3 and 4; together with numerous playing pieces placed on the board surface of identical colored squares and moved along an unoccupied matching colored path diagonal to the square or bicolored matrix, except when jumping an opponents playing piece which is accomplished by moving vertically or diagonally to the next unoccupied square or bicolored square matrix containing an identical color.

The above mentioned board and playing pieces have been especially designed for a game to be known as Quadracheck, similar to the game of checkers, except that said game can be played by two, three or four persons, including partners; also by two persons each maneuvering two sets of disks simultaneously. When any of the above said groups are participating in said game, playing disks are placed on outside rectangular squares of corresponding colors. The object of the game is to advance playing pieces to opposite sides of the board, attempting to jump opponents disks and remove them from the board, thereby remaining the final player or partners on the board. The playing pieces consist of 24 small disks, 6 each of four different colors matching the same colors on the board. Each player is required to place 6 disk of the same color on matching colored squares, and move forward in turn one space diagonally except when jumping opposing players' disks. Jumping can be accomplished both diagonally and vertically forward, but never horizontally. The adjacent space must be occupied by an opposing player before jumping can be accomplished. Moving must be done on colored squares or matrices corresponding to colored disks. The design of the matrices will allow two different colored disks to occupy the same matrix at different intervals of play. When reaching the final horizontal row of your own colored squares you receive an additional disk placed on top of an existing disk, and this allows you to move both forward and backwards. Once you leave colored squares located in either of the rectangular portions you may not return.

The following description is made in conjunction with the attached drawing.

Figure 2:
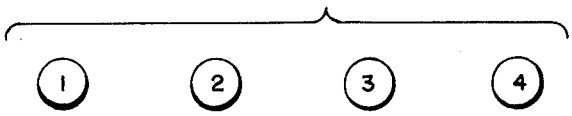
FIG. 2 is a composite view showing one piece of each of four different colored sets of playing pieces.

Referring to said views of said game, the equipment is shown to include playing pieces. Board and playing disks can be made of various materials. Drawn or etched on the surface of the board material is a center square matrix with intersecting parallel lines, and within these lines diagonals are drawn forming equally shaped matrices, with numerals designating colors of the triangles in said matrices; extending from the center are four rectangles intersected by perpendicular lines to form equal squares with numerals designating colors of the squares. FIG. 2 shows playing pieces and numeral designations matching the designations of squares and matrices on the board surface.

Figure 1:
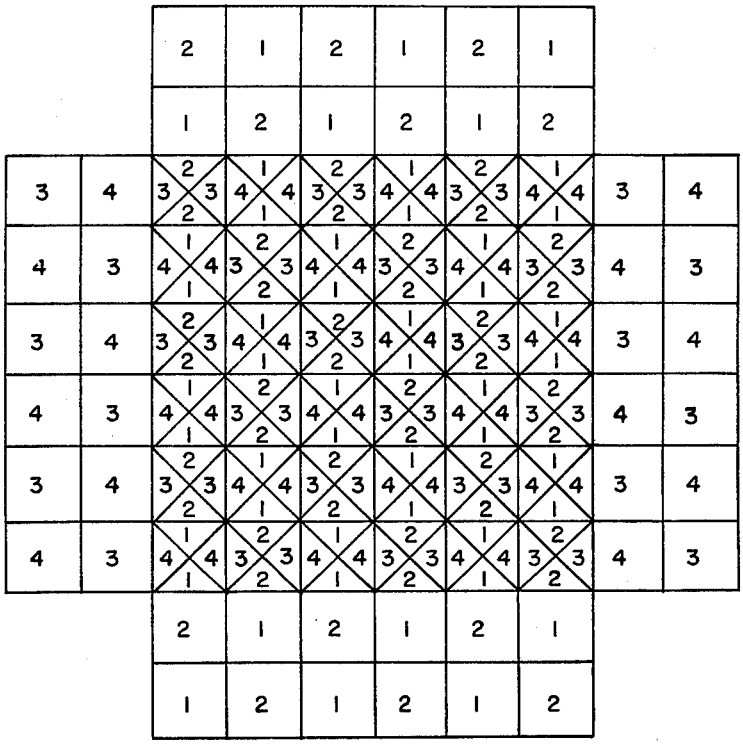
FIG. 1 is a plan view of the game board to be used, indicating by numerals the color designations for moving purposes.

I claim:

1. Board game apparatus comprising a game board having the configuration shown in FIG. 1 of the drawing and having on its surface the game pattern shown in said FIG. 1, the numerals in said figure representing four different colors on equivalent indicia, and four sets of game pieces, each set being of a different one of said colors or equivalent indicia.

* * * * *

UNITED STATES PATENT OFFICE

CERTIFICATE OF CORRECTION

Patent No. 4,037,843 Dated July 26, 1977

Inventor(s) Alfred J. Hoffman

It is certified that error appears in the above-identified patent and that said Letters Patent are hereby corrected as shown below:

Column 2, Claim 1, line 42, "on" should read -- or --.

Signed and Sealed this

First Day of November 1977

[SEAL]

*Attest:*

RUTH C. MASON
*Attesting Officer*

LUTRELLE F. PARKER
*Acting Commissioner of Patents and Trademarks*